US006520419B2

(12) United States Patent
Hirota et al.

(10) Patent No.: US 6,520,419 B2
(45) Date of Patent: Feb. 18, 2003

(54) SUPERCOOLING DEGREE CONTROL TYPE EXPANSION VALVE

(75) Inventors: Hisatoshi Hirota, Tokyo (JP); Yuusuke Inoue, Tokyo (JP)

(73) Assignee: TGK Co., Ltd., Tokyo (JP)

( * ) Notice: Subject to any disclaimer, the term of this patent is extended or adjusted under 35 U.S.C. 154(b) by 0 days.

(21) Appl. No.: 09/875,801

(22) Filed: Jun. 6, 2001

(65) Prior Publication Data

US 2002/0005436 A1 Jan. 17, 2002

(30) Foreign Application Priority Data

Jun. 21, 2000 (JP) ..... 2000-185689

(51) Int. Cl.[7] ..... G05D 27/00
(52) U.S. Cl. ..... 236/92 B; 137/513.5
(58) Field of Search ..... 62/527, 528, 511; 236/92 B; 137/513.3, 513.5

(56) References Cited

U.S. PATENT DOCUMENTS

| | | | | |
|---|---|---|---|---|
| 4,601,305 A | | 7/1986 | Nordskog | 137/528 |
| 4,633,681 A | | 1/1987 | Webber | 62/511 |
| 5,052,192 A | * | 10/1991 | Drucker | 137/493 B |
| 5,265,438 A | * | 11/1993 | Knowles et al. | 137/513.3 |
| 5,613,518 A | * | 3/1997 | Rakieski | 137/513.5 |
| 5,689,972 A | * | 11/1997 | Schuster et al. | 137/513.3 |
| 5,894,741 A | * | 4/1999 | Durham et al. | 137/493.8 |
| 6,289,924 B1 | * | 9/2001 | Kozinski | 137/497 |

FOREIGN PATENT DOCUMENTS

| | | |
|---|---|---|
| EP | 0 279 622 | 8/1988 |
| EP | 0 987 505 | 3/2000 |

* cited by examiner

*Primary Examiner*—William L. Tapolcal
*Assistant Examiner*—Mohammad M. Ali
(74) *Attorney, Agent, or Firm*—Patterson, Thuente, Skaar & Christensen LLC

(57) ABSTRACT

A supercooling degree control type expansion valve which is capable of preventing seizure of a compressor when the compressor is at a low load condition.

A valve seat is integrally formed with a body, in a refrigerant passage through which refrigerant flows via a strainer, and a valve element arranged in a manner opposed to the valve seat and urged by a spring from the downstream side of the refrigerant passage so as to be seated onto the valve seat, whereby a differential pressure regulating valve is constructed. A spring-receiving member is fitted in a downstream end of the body, and the spring-receiving member is formed with a restriction passage. The valve element has an oil passage formed therethrough, and even when the differential pressure regulating valve is closed during low load operation of the compressor, it is possible to cause the refrigerant to flow at the minimum flow rate required via the oil passage. This makes it possible to return oil contained in the refrigerant to the compressor, whereby the seizure of the compressor can be prevented.

14 Claims, 10 Drawing Sheets

SUPERCOOLING DEGREE CONTROL TYPE EXPANSION VALVE

BACKGROUND OF THE INVENTION (1) Field of the Invention

This invention relates to a supercooling degree control type expansion valve, and more particularly to a supercooling degree control type expansion valve for use in a refrigeration cycle of an air conditioning system for an automotive vehicle.

(2) Description of the Related Art

As the refrigeration cycle of an air conditioning system for an automotive vehicle, there has been widely employed one using a receiver/dryer arranged at an outlet side of a condenser for storing a superfluous refrigerant and subjecting the stored refrigerant to air-liquid separation, a thermal expansion valve for controlling the flow rate of the refrigerant flowing into the evaporator according to the pressure and temperature of a low-pressure refrigerant delivered from the evaporator.

On the other hand, another refrigeration cycle is also known which uses an accumulator arranged at an outlet side of an evaporator, for storing a superfluous refrigerant and subjecting the stored refrigerant to air-liquid separation, and a supercooling degree control type expansion valve comprised of a restriction passage (orifice) for control of the flow rate of the refrigerant according to the degree of supercooling and dryness of a high-pressure refrigerant delivered from a condenser, and a differential pressure regulating valve for carrying out control such that the refrigerant is cooled to a predetermined supercooling degree.

FIG. 10 is a cross-sectional view showing the construction of a conventional supercooling degree control type expansion valve.

The conventional supercooling degree control type expansion valve 1 has a body 2 in the form of a hollow cylinder having a portion at a left side, as viewed in FIG. 10, which is connected to the upstream side of a refrigeration cycle, with part of a side wall thereof being formed with a large opening into which a strainer 3 is fitted. The body 2 has a refrigerant passage extending through a central portion of the body 2 and having an intermediate portion formed with a stepped portion which constitutes a valve seat 4. A valve element 5 is axially movably arranged in the passage in a manner opposed to the valve seat 4 from the downstream side, and the valve element 5 is urged in a valve-closing direction by a spring 6 arranged on a downstream side thereof. Further, the body 2 has a lower end thereof fitted with a spring-receiving member 7, and the spring-receiving member 7 has an annular orifice 8 formed therethrough which communicates with the outside. The body 2 has an O ring 9 fitted on the periphery thereof.

In the supercooling degree control type expansion valve 1 constructed as above, when the refrigeration cycle is operating at a low load condition or the compressor is rotating at a low rotational speed, the refrigeration cycle is at a low pressure condition as a whole, so that the valve element 5 is urged by the spring 6 against the valve seat 4 to hold the valve 1 in a closed state, which inhibits the refrigerant from flowing therethrough.

When the refrigeration cycle is operating at a normal load condition, a high-pressure refrigerant from a condenser, not shown, is first filtered by the strainer 3, and then introduced into the upstream side of the valve element 5. When the pressure of the refrigerant introduced into the upstream side of the valve element 5 becomes higher or stronger than the urging force of the spring 6, the valve element 5 leaves the valve seat 4 whereby the refrigerant flows to the downstream side of the valve seat 4, and further passes through the annular orifice 8 in the valve-receiving member 7, where the refrigerant undergoes thermal expansion and then flows to an evaporator, not shown. During the process, the valve element 5 controls the flow rate of the refrigerant depending on the balance between the differential pressure between the upstream side and the downstream side of the valve seat 4, and the urging force of the spring 6.

When the temperature of the outside air is low e.g. during winter, or when the rotational speed of the engine is low e.g. during idling operation of the engine, the pressure of the whole refrigeration cycle is low. Therefore, when the introduced pressure is low e.g. at a low load condition, there can arise a situation in which the valve element does not open but remains closed to inhibit the flow of the refrigerant.

The refrigerant for circulation, however, contains oil for lubrication of the compressor, and hence in the case of the conventional supercooling degree control type expansion valve, if the refrigerant ceases to flow, the amount of oil returning to the compressor decreases, which in worst cases, causes seizure of the compressor due to shortage of the oil.

Further, when the vehicle is running at a high speed, the rotational speed of the compressor is increased to increase the pressure within the refrigeration cycle. Therefore, it is necessary to configure the supercooling degree control type expansion valve such that it withstands high pressure from the viewpoint of safety. Further, the power of the compressor is increased to a larger degree than required for cooling, which degrades the coefficient of performance of the refrigeration cycle as well as fuel economy.

SUMMARY OF THE INVENTION

The present invention has been made in view of the above problems and an object thereof is to provide a supercooling degree control type expansion valve which is capable of preventing seizure of a compressor, at a low load condition.

Further, another object of the present invention is to provide a supercooling degree control type expansion valve which is capable of preventing the pressure from rising when the vehicle is running at a high speed.

To solve the above problem, the present invention provides a supercooling degree control type expansion valve including a restriction passage arranged in a refrigerant passage through which a refrigerant flows, for subjecting the refrigerant introduced to adiabatic expansion, and a differential pressure regulating valve arranged on an upstream side of the restriction passage, for carrying out control such that the refrigerant introduced has a predetermined cooling degree, characterized by comprising differential pressure regulating valve bypass means for allowing the refrigerant to flow therethrough at a minimum refrigerant flow rate required for a compressor even when the differential valve is closed.

According to this supercooling degree control type expansion valve, although the differential pressure is closed when the rotational speed of the engine is low and the compressor is at a low load condition, it is still possible in such a case to cause part of the introduced refrigerant to flow via the differential pressure regulating valve bypass means, which makes it possible to return the oil contained in the refrigerant to the compressor, to thereby prevent seizure of the compressor.

Further, according to the invention, the restriction passage includes passage area-varying means for increasing a passage area thereof in response to received pressure which is higher than a predetermined pressure. Owing to the provision of the passage area-varying means, when the refrigerant at a high pressure is introduced due to a high rotational speed of the compressor which is caused e.g. when the vehicle is running at a high speed, the passage area-varying means increases the passage area of the restriction passage to thereby increase the flow rate of a refrigerant flowing through the restriction passage, which makes it possible to prevent the pressure from rising, and hence prevent breakage due to pressure, and degradation of the coefficient of performance and fuel economy.

The above and other objects, features and advantages of the present invention will become apparent from the following description when taken in condjunction with the accompanying drawings which illustrate preferred embodiments of the present invention by way of example.

BRIEF DESCRIPTION OF THE DRAWINGS

FIG. 1 is diagrams showing the construction of a supercooling degree control type expansion valve according to a first embodiment of the invention, in which

FIG. 2 is diagrams showing the construction of a supercooling degree control type expansion valve according to a second embodiment of the invention, in which

FIG. 4 is diagrams showing the construction of a supercooling degree control type expansion valve according to a third embodiment of the invention, in which

FIG. 7 is diagrams showing the construction of the supercooling degree control type expansion valve according to the fifth embodiment of the invention, in which

FIG. 8 is diagrams showing the construction of a supercooling degree control type expansion valve according to a sixth embodiment of the invention, in which

DESCRIPTION OF THE PREFERRED EMBODIMENTS

The present invention will now be described in detail with reference to drawings showing preferred embodiments thereof.

Figure 1A:
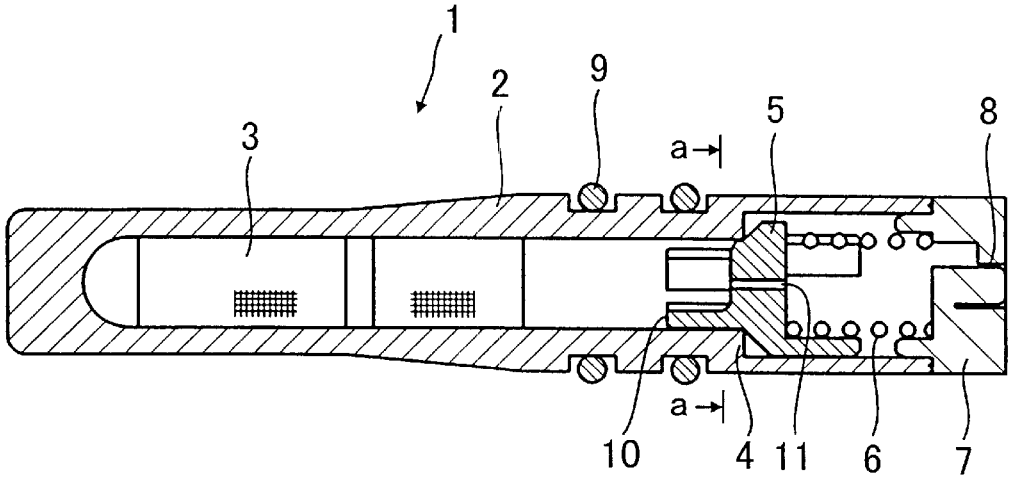
FIG. 1(A) is a cross-sectional view of the valve.
Figure 1B:
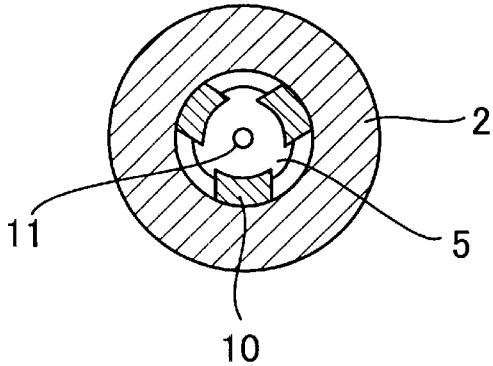
FIG. 1(B) is an enlarged cross-sectional view of the same taken on line a—a of FIG. 1(A)
Figure 10:
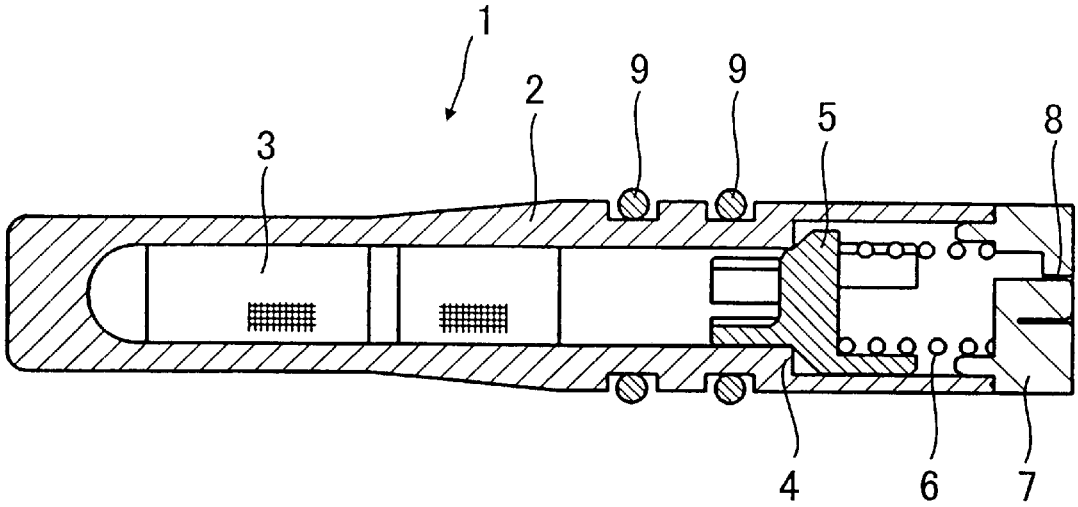
PRIOR ART FIG.10
FIG. 10 is a cross-sectional view showing an example of the construction of a conventional supercooling degree control type expansion valve.

FIG. 1 shows the construction of a supercooling degree control type expansion valve according to a first embodiment of the invention. FIG. 1(A) is a cross-sectional view of the valve, and FIG. 1(B) is an enlarged cross-sectional view of the same taken on line a—a of FIG. 1(A). It should be noted that component parts identical to those of the FIG. 10 valve are designated by identical numerals.

The supercooling degree control type expansion valve 1 of the invention has a body 2, and a strainer 3 fitted in a portion of the body 2 where a high-pressure refrigerant is introduced from the upstream side of a refrigeration cycle. A refrigerant passage extends through a central portion of the body 2 into which the refrigerant is introduced via the strainer 3, and is formed with a stepped portion constituting a valve seat 4.

A valve element 5 is axially movably arranged in the refrigerant passage in a manner opposed to the valve seat 4 from the downstream side of the refrigerant passage. The valve element 5 has three legs 10 formed on an upstream side thereof such that the legs 10 protrude via an opening of the valve seat 4 into a portion of the refrigerant passage upstream of the valve seat 4, whereby the legs 10 guide the axial movement of the valve element 5. Legs similar to the legs 10 are also formed on a downstream side of the valve element 5, such they protrude into a portion of the refrigerant passage downstream of the valve seat 4, whereby the legs guide the axial movement of the valve element 5. Further, the valve element 5 has an oil passage 11 formed therethrough which extends along the axis thereof with a very small cross-sectional area.

Further, at a location downstream of the valve seat 4, a spring 6 is arranged in a manner urging the valve element 5 in a valve-closing direction. The spring 6 is supported by a valve-receiving member 7 fitted in a downstream end of the body 2. The valve seat 4, the valve element 5, and the spring 6 constitute a differential pressure regulating valve. The spring-receiving member 7 is formed therethrough with a restriction passage which forms an orifice for restricting the flow of a refrigerant. The restriction passage 8 is annularly formed such that no hole is formed from outside, while a recess is formed in a refrigerant passage-side surface of the spring-receiving member 7 such that the recess communicates with part of the restriction passage 8. This causes the refrigerant within the refrigerant passage accommodating the spring 6 to be discharged in an annular form in cross-section via the restriction passage 8, thereby reducing the sound generated by passing of the refrigerant therethrough. The body 2 has an O ring 9 fitted on the outer periphery thereof.

In the supercooling degree control type expansion valve 1 constructed as described above, when the refrigeration cycle is operating at a low load condition, or when the compressor is rotating a low rotational speed, the pressure of the refrigerant introduced into the supercooling degree control type expansion valve 1 is low, so that the valve element 5 is urged by the spring 6 against the valve seat 4, whereby the valve 1 is held in a closed state. However, the low-pressure refrigerant flows through the oil passage 11 formed through the valve element 5, and further through the restriction passage 8 toward the evaporator. This makes it possible to secure the return of oil at a minimum flow rate required when the compressor is operating at the low rotational speed.

During a normal load operation, the high-pressure refrigerant from the condenser is first filtered by the strainer 3, and then introduced into the upstream side of the valve element 5. At this time, depending on the balance between the differential pressure between the upstream side and the downstream side of the valve seat 4, and the urging force of the spring 6, the valve element 5 is moved to leave the valve seat 4, thereby control the flow rate of the introduced refrigerant passing therethrough. The refrigerant having passed through this differential pressure regulating valve passes through the annular restriction passage 8 of the spring-receiving member 7, and is supplied to the evaporator.

Figure 2A:
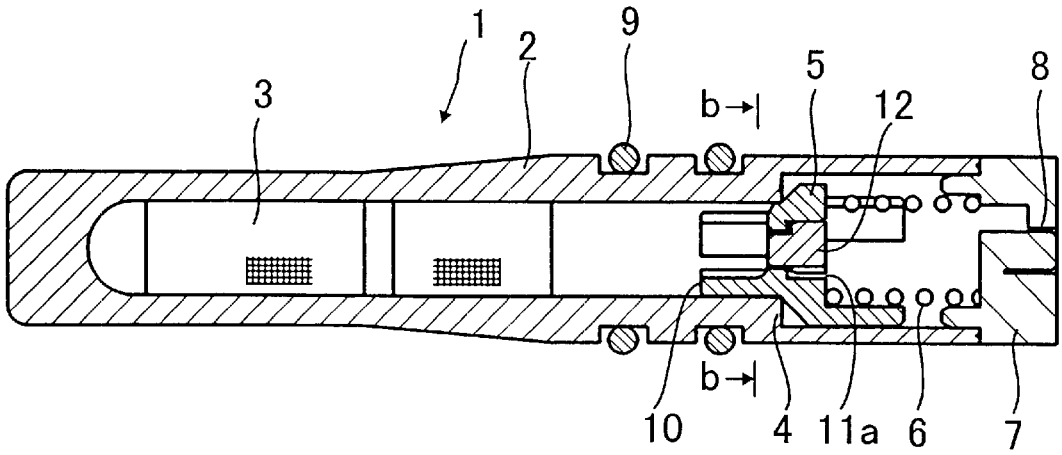
FIG. 2(A) is a cross-sectional view of the valve.
Figure 2B:
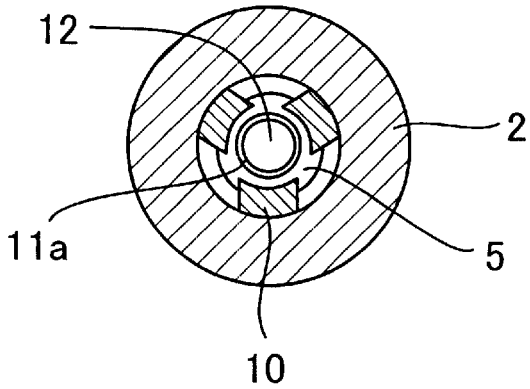
FIG. 2(B) is an enlarged cross-sectional view of the same taken on line b—b of FIG. 2(A)
Figure 3:
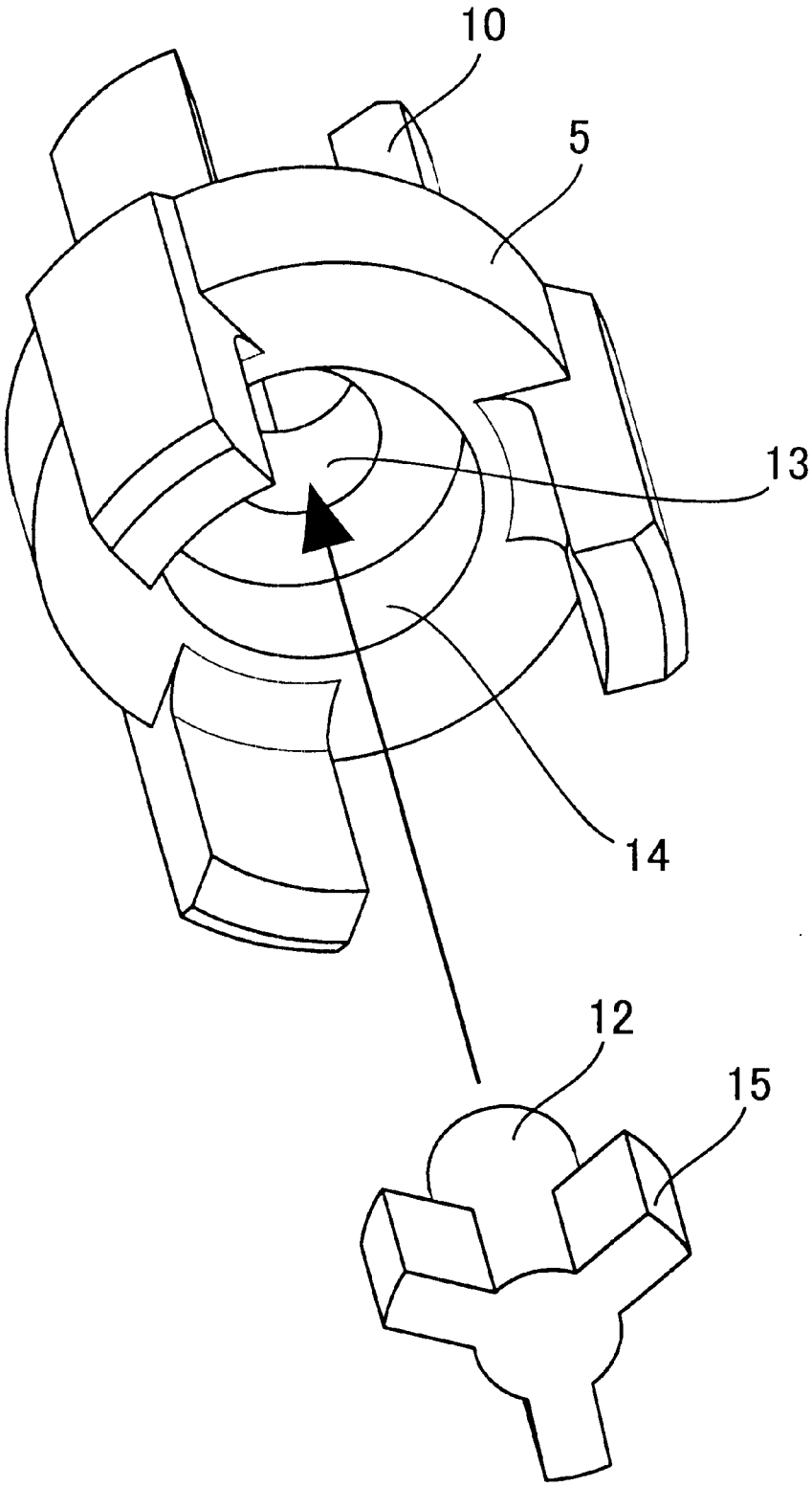
FIG. 3 is an exploded perspective view of a valve element of the supercooling degree control type expansion valve according to the second embodiment of the invention.

FIG. 2 shows the construction of a supercooling degree control type expansion valve according to a second embodiment of the invention. FIG. 2(A) is a cross-sectional view of the valve, and FIG. 2(B) is an enlarged cross-sectional view of the same taken on line b—b of FIG. 2(A). FIG. 3 is an exploded perspective view of a valve element of the supercooling degree control type expansion valve according to the second embodiment. It should be noted that component parts in FIGS. 2 and 3 which are identical to those of the FIG. 1 valve are designated by identical numerals, and detailed description thereof will be omitted.

In the second embodiment, a valve element 5 has a plug 12 loosely fitted therein to thereby form an oil passage 11*a* in the form of an annulus. More specifically, the valve element 5 has a small-diameter hole 13 and a large-diameter hole 14 formed therethrough along an axis thereof. The plug 12 has an outer diameter slightly smaller than the inner diameter of the small-diameter hole 13, and three protrusions 15 formed along the circumference thereof which have respective ends thereof brought into pressure contact with the inner wall of the large-diameter hole 14. By press-fitting the protrusions 15 into the large-diameter hole 14 of the valve element 5, the plug 12 is positioned in the center of the small-diameter hole 13, whereby the oil passage 11*a* in the form of an annulus is formed between the inner peripheral surface of the small-diameter hole 13 and the outer peripheral surface of the plug 12.

Even if the valve element 5 is closed due to a decrease in pressure of the refrigerant, when the refrigeration cycle is operating at a low load condition, or when the compressor is rotating a low rotational speed, the oil passage 11*a* configured as described above allows the refrigerant to flow which contains oil at the minimum flow rate required when the compressor is operating at the low rotational speed.

Figure 4A:
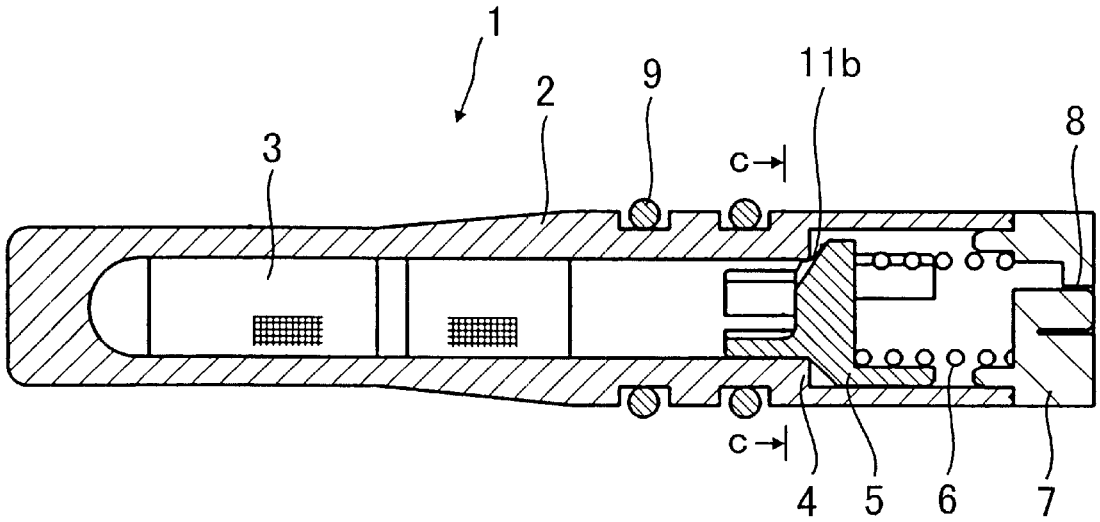
FIG. 4(A) is a cross-sectional view of the valve.
Figure 4B:
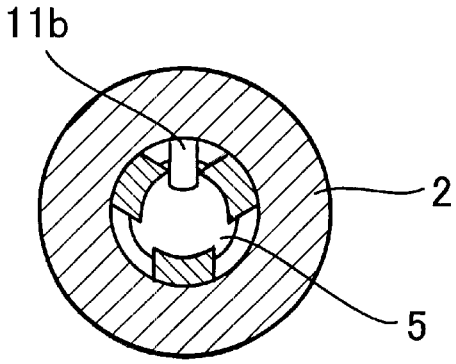
FIG. 4(B) is an enlarged cross-sectional view of the same taken on line c—c of FIG. 4(A)

FIG. 4 shows the construction of a supercooling degree control type expansion valve according to a third embodiment of the invention. FIG. 4(A) is a cross-sectional view of the valve, and FIG. 4(B) is an enlarged cross-sectional view of the same taken on line c—c of FIG. 4(A). It should be noted that component parts in FIG. 4 which are identical to those of the FIG. 1 valve are designated by identical numerals, and detailed description thereof will be omitted.

In the third embodiment, a conical portion of a valve element 5 brought into contact with a valve seat 4 is formed with a slit 11*b* to provide an oil passage. Even if the valve element 5 is seated onto the valve seat 4 to close the valve due to a decrease in pressure of the refrigerant, when the refrigeration cycle is operating at a low load condition, or when the compressor is rotating a low rotational speed, the slit 11*b* secures a passage to allow the refrigerant to flow at the minimum flow rate, and thereby return oil to the compressor.

Figure 5:
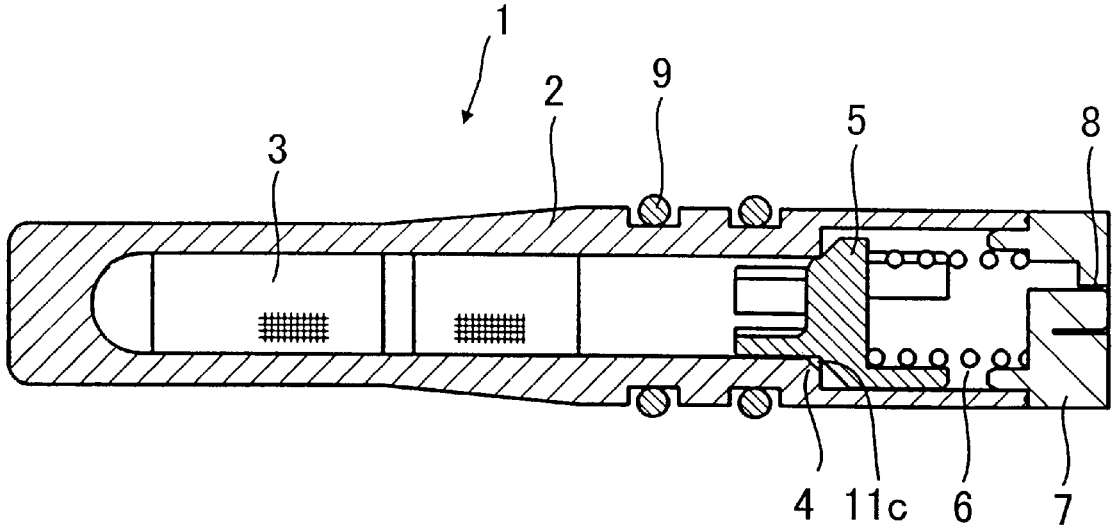
FIG. 5 is a cross-sectional view of a supercooling degree control type expansion valve according to a fourth embodiment of the invention.

FIG. 5 is a cross-sectional view showing the construction of a supercooling degree control type expansion valve according to a fourth embodiment of the invention. It should be noted that component parts in FIG. 5 which are identical to those of the FIG. 1 valve are designated by identical numerals, and detailed description thereof will be omitted.

In the fourth embodiment, a slit 11*c* is formed in a valve seat 4 to provide an oil passage. Even if the valve element 5 is seated onto the valve seat 4 to close the valve due to a decrease in pressure of the refrigerant, when the refrigeration cycle is operating at a low load condition, or when the compressor is rotating a low rotational speed, the slit 11*c* secures a passage to allow the refrigerant to flow at the minimum flow rate and thereby return oil to the compressor.

Figure 6:
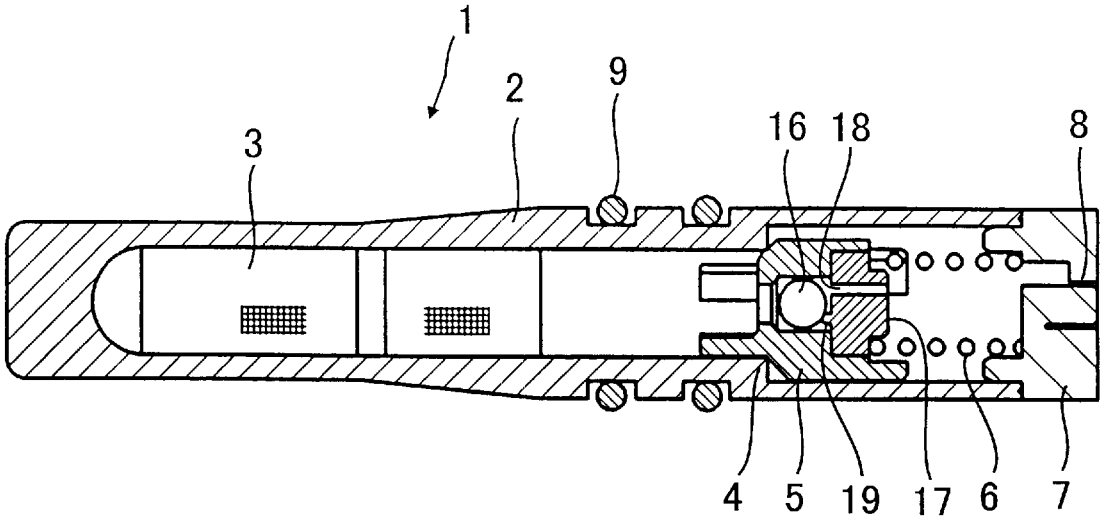
FIG. 6 is a cross-sectional view of a supercooling degree control type expansion valve according to a fifth embodiment of the invention in a state in which a refrigerant is flowing in a normal direction.
Figure 7A:
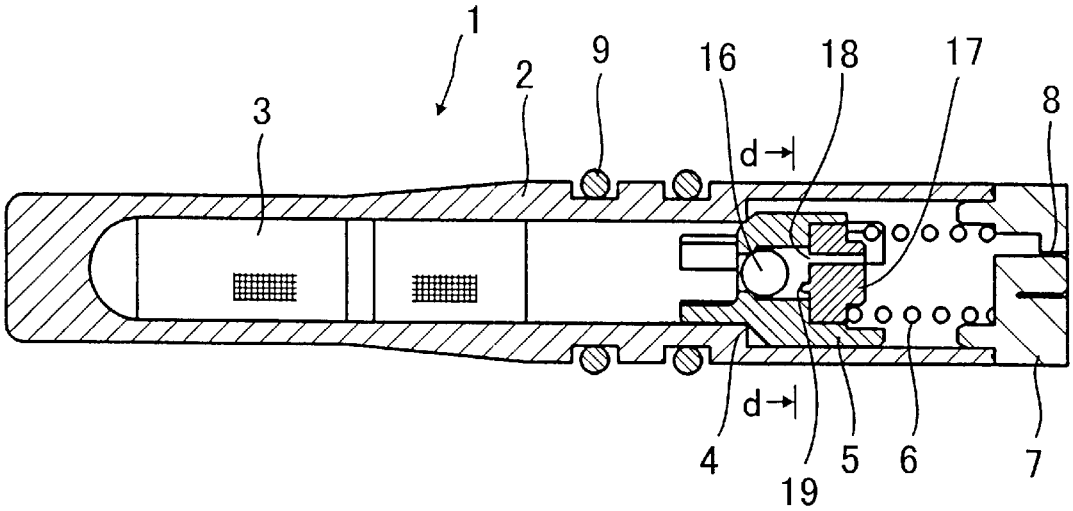
FIG. 7(A) is a cross-sectional view of the valve in which the refrigerant is flowing in a reverse direction.
Figure 7B:
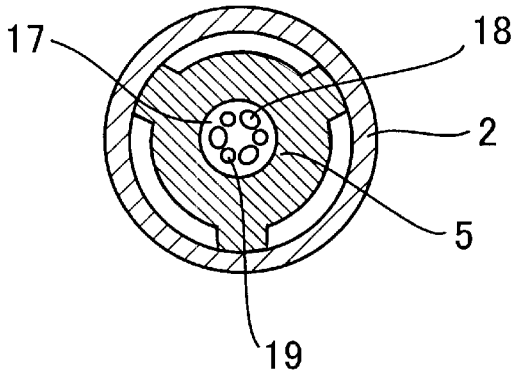
FIG. 7(B) is an enlarged cross-sectional view of the same taken on line d—d of FIG. 7(A)

FIG. 6 is a cross-sectional view showing a supercooling degree control type expansion valve according to a fifth embodiment of the invention in a state in which the refrigerant is flowing in a normal direction, while FIG. 7 shows the construction of the supercooling degree control type expansion valve according to the fifth embodiment of the invention. FIG. 7(A) is a cross-sectional view of the valve in a state in which the refrigerant is flowing in a reverse direction, and FIG. 7(B) is an enlarged cross-sectional view of the same taken on line d—d of FIG. 7(A). It should be noted that component parts in FIGS. 6 and 7 which are identical to those of the FIG. 1 valve are designated by identical numerals, and detailed description thereof will be omitted.

In the fifth embodiment, a check valve is arranged in the oil passage 11 in the first embodiment, whereby the backflow of the refrigerant is prevented.

A valve 5 has an oil passage formed along the axis thereof with a ball 16 being axially movably arranged therein in a loosely fitted manner. A portion of the oil passage on the upstream side of the ball 16 provides a valve seat for receiving the ball 16, while in a portion of the same on the downstream side of the ball 16, a plug 17 is fitted. The plug 17 has through holes 18 axially formed therethrough. The through holes 18 are arranged in three on a concentric circle at equal intervals, as shown in FIG. 7(B), and three protrusions 19 protruding toward the upstream side are formed respectively between the three through holes 18. The protrusions 19 prevent the through holes from being closed by the ball 16 when the ball 16 is brought into contact with the plug 17 by the flow of the refrigerant in the normal direction.

When a high-pressure refrigerant is introduced into a portion of the supercooling degree control type expansion valve 1 on the side where the strainer 3 is arranged, the ball 16 is in contact with the protrusions 19 of the plug 17, as shown in FIG. 6, whereby an oil passage is formed. Even if the valve element 5 is seated onto the valve seat 4 to close the valve due to a decrease in pressure of the refrigerant, when the refrigeration cycle is operating at a low load condition, or when the compressor is rotating a low rotational speed, the oil passage makes it possible to secure the flow of refrigerant at the minimum flow rate required and thereby return oil to the compressor.

On the other hand, when the pressure at the outlet side of the restriction passage 8 of the supercooling degree control type expansion valve 1 becomes high, the high-pressure refrigerant causes the ball 16 to be seated on its seat to close the valve. This closes the oil passage whereby the backflow of refrigerant can be prevented.

The supercooling degree control type expansion valve 1 comprised of a differential pressure regulating valve with a check valve is useful for cases in which the pressure at the outlet side of the restriction passage 8 can become high e.g. by switching of the flow path of refrigerant, depending on a configuration of the piping forming components of the refrigeration cycle.

Figure 8A:
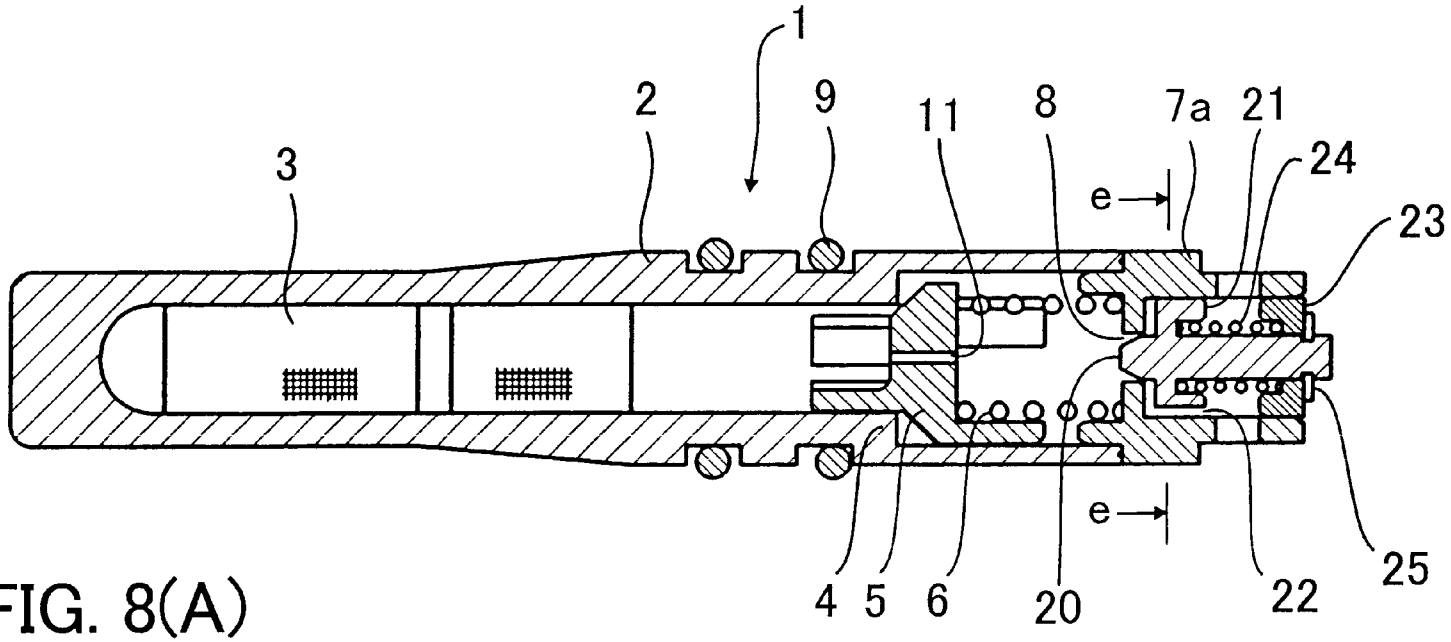
FIG. 8(A) is a cross-sectional view of the valve in a state in which the pressure is normal.
Figure 8B:
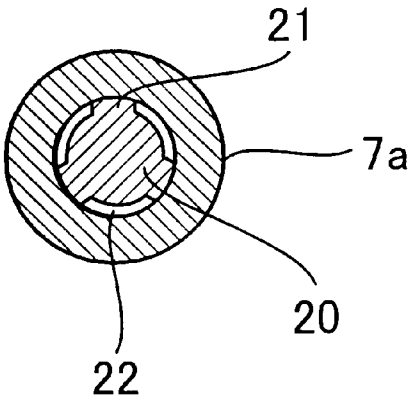
FIG. 8(B) is a cross-sectional view of the same taken on line e—e of FIG. 8(A)

FIG. 8 shows the construction of a supercooling degree control type expansion valve according to a sixth embodiment of the invention. FIG. 8(A) is a cross-sectional view of the valve in a state in which the refrigerant is at a normal pressure, and FIG. 8(B) is a cross-sectional view of the same taken on line e—e of FIG. 8(A).

Figure 9:
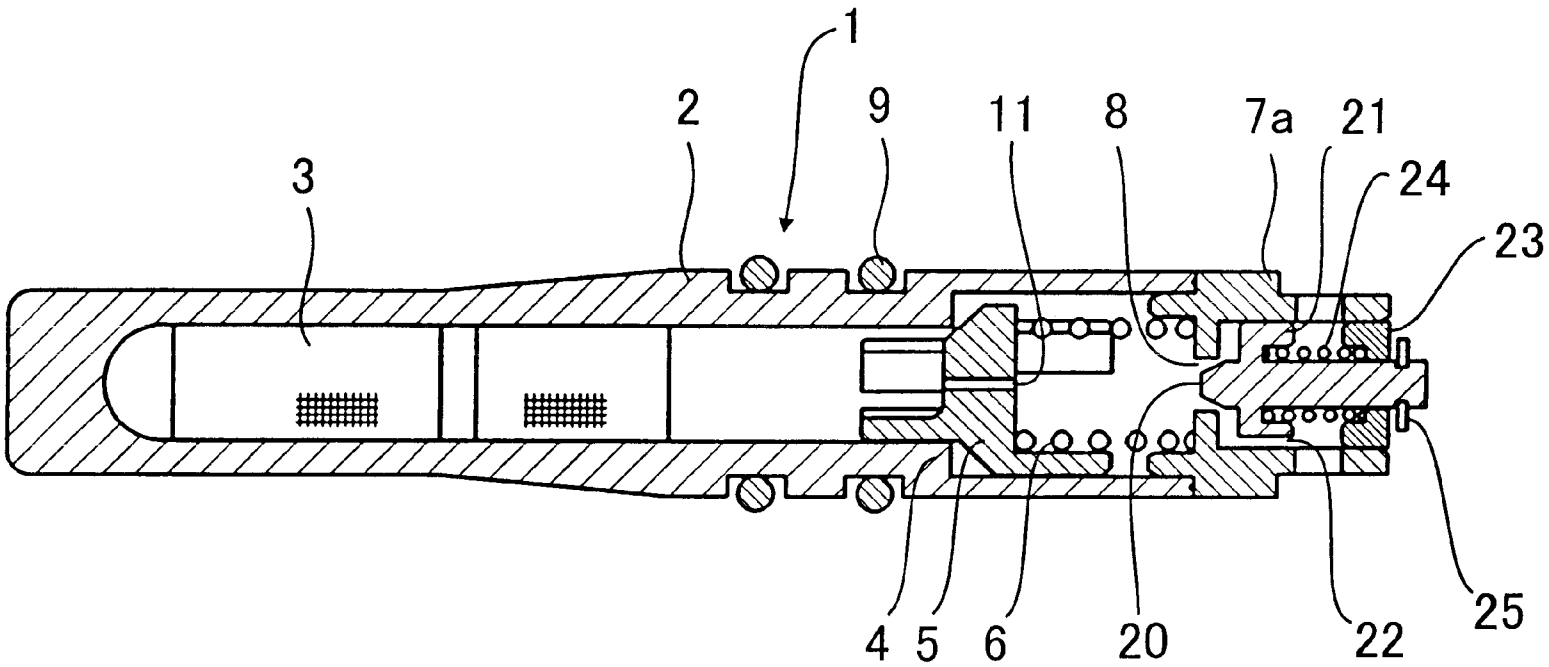
FIG. 9 is a cross-sectional view of a supercooling degree control type expansion valve according to the sixth embodiment of the invention, in a state in which the high pressure is avoided.

FIG. 9 is a cross-sectional view of the supercooling degree control type expansion valve according to the sixth embodiment of the invention in a state in which the high pressure condition is avoided. It should be noted that component parts in FIGS. 8 and 9 which are identical to those of the FIG. 1 valve are designated by identical numerals, and detailed description thereof will be omitted.

The sixth embodiment includes a mechanism arranged on a downstream side of a differential pressure regulating valve thereof, for varying an orifice area in response to a high pressure received thereat.

More specifically, a spring-receiving member 7*a* fitted in a refrigerant outlet side end of the supercooling degree control type expansion valve 1 is formed by a hollow cylindrical portion, and a ring portion integrally formed with the hollow cylindrical portion and having an opening extending through a central portion of thereof. A portion of a shaft 20 is inserted into the opening to thereby form a restriction passage 8 in the form of an annulus. The shaft 20 has guide members 21 integrally formed therewith along its circumference, for axially movably guiding the shaft 20 while positioning the shaft 20 on the axis of the spring-receiving member 7*a*. Between the guide members 21, there are formed passages 22 through which the refrigerant having passed through the restriction passage 8 in the form of an annulus passes. Further, the shaft 20 is urged in an upstream direction by a spring 24 interposed between the shaft 20 and a spring-receiving member 23 fitted in an end of the spring receiving member 7*a,* and at the same time, restricted in position in an axial direction by a stopper 25 such that the restriction passage 8 having a predetermined orifice area is formed between the shaft 20 and the opening of the ring portion.

When the pressure of the refrigerant within the refrigeration cycle is normal, the shaft 20 is held by the urging force of the spring 24 in a position shown in FIG. 8. Therefore, the supercooling degree control type expansion valve 1 according to this embodiment operates quite in the same manner as the supercooling degree control type expansion valve 1 according to the first embodiment.

Further, if the rotational speed of the compressor becomes high and the pressure within the refrigeration cycle as a whole becomes high, e.g. when the vehicle is running at a high speed, the pressure of the refrigerant introduced into the supercooling degree control type expansion valve 1 and having passed through the differential pressure also becomes high. The pressure of the refrigerant having passed the differential pressure is received by the upstream-side end face of the shaft 20 defining the restriction passage 8, and when the pressure exceeds a predetermined value, the shaft 20 overcomes the urging force of the spring 20 to move in a downstream direction, as shown in FIG. 9. This increase the orifice area of the restriction passage 8 to thereby increase the flow rate of refrigerant flowing though the restriction passage 8 and the passages 22, so that the pressure of the refrigerant decreases. This makes it possible to prevent a further increase in the pressure of the refrigerant.

Although the supercooling degree control type expansion valve according to the invention is assumed to be employed in a refrigeration cycle using chlorofluorocarbon HFC-134*a* as the refrigerant, this is not limitative, but it can be similarly applied to refrigeration cycles using carbon dioxide ($CO_2$), a hydrocarbon (HC), ammonia ($NH_3$), etc.

As described above, according to the present invention, an oil passage that allows a refrigerant to flow by bypassing a differential pressure regulating valve. Although the differential pressure is closed when the pressure of refrigerant introduced becomes so low as will not be able to open the differential pressure regulating valve during low-load low-rotational speed operation, it is possible even in such a case to cause the refrigerant to flow to the compressor at a minimum flow rate required for a compressor via the oil passage, which makes it possible to return a sufficient, amount of oil to the compressor, to thereby prevent seizure of the same.

Further, provision of the check valve in the oil passage makes it possible to close the oil passage e.g. when the pressure at the outlet side of the supercooling degree control type expansion valve becomes high, whereby the backflow of the refrigerant can be prevented.

Further, owing to provision of means for varying the orifice area of a restriction passage in response to received pressure which is higher than a predetermined pressure, the pressure of refrigerant, which may be increased e.g. when the vehicle is running at a high speed, is prevented from becoming higher than a predetermined value by increasing the orifice area. This enhances the safety of the apparatus from high pressure, and further prevents degradation of the coefficient of performance, and fuel economy.

The foregoing is considered as illustrative only of the principles of the present invention. Further, since numerous modifications and changes will readily occur to those skilled in the art, it is not desired to limit the invention to the exact construction and applications shown and described, and accordingly, all suitable modifications and equivalents may be regarded as falling within the scope of the invention in the appended claims and their equivalents.

What is claimed is:

1. A supercooling degree control type expansion valve including a restriction passage arranged in a refrigerant passage through which a refrigerant flows, for subjecting the refrigerant introduced to adiabatic expansion, and a differential pressure regulating valve arranged on an upstream side of the restriction passage, for carrying out control such that the refrigerant introduced has a predetermined cooling degree, characterized by comprising differential pressure regulating valve bypass means for allowing the refrigerant to flow therethrough at a minimum refrigerant flow rate required for a compressor even when the differential valve is closed.

2. A supercooling degree control type expansion valve according to claim 1, wherein said differential pressure regulating valve bypass means is a passage formed through a valve element of the differential pressure regulating valve and having a very small cross-sectional area.

3. A supercooling degree control type expansion valve according to claim 1, wherein said differential pressure regulating valve bypass means is a passage in the form of an annulus formed by positioning, in a through passage formed through a valve element of the differential pressure regulating valve, a plug member having a profile smaller than a profile of the through passage, on an identical axis.

4. A supercooling degree control type expansion valve according to claim 1, wherein said differential pressure regulating valve bypass means is a slit formed in a seating surface of the valve element.

5. A supercooling degree control type expansion valve according to claim 1, wherein said differential pressure regulating valve bypass means is a slit formed in a valve seat surface on which the valve element is seated.

6. A supercooling degree control type expansion valve according to claim 1, wherein said differential pressure regulating valve bypass means includes a check valve for closing when pressure on a downstream side of the differential pressure regulating valve becomes higher than pressure on an upstream side of the differential pressure regulating valve.

7. A supercooling degree control type expansion valve according to claim 1, wherein the restriction passage includes passage area-varying means for increasing a passage area thereof in response to received pressure which is higher than a predetermined pressure.

8. A supercooling degree control type expansion valve including a restriction passage arranged in a refrigerant passage through which a refrigerant flows, for subjecting the refrigerant introduced to adiabatic expansion, and a differential pressure regulating valve arranged on an upstream side of the restriction passage, for carrying out control such that the refrigerant introduced has a predetermined cooling degree, characterized by comprising differential pressure regulating valve bypass means for allowing the refrigerant to flow therethrough at a minimum refrigerant flow rate required for a compressor even when the differential valve is closed;

wherein refrigerant flow through the differential pressure regulating valve bypass means is in the same direction as refrigerant flow through the differential pressure regulating valve when said valve is open.

9. A supercooling degree control type expansion valve according to claim 8, wherein said differential pressure regulating valve bypass means comprises a passage formed through a valve element of the differential pressure regulating valve and having a small cross-sectional area.

10. A supercooling degree control type expansion valve according to claim 8, wherein said differential pressure regulating valve bypass means comprises a passage in the form of an annulus formed by positioning, in a through passage formed through a valve element of the differential pressure regulating valve, a plug member having a profile smaller than a profile of the through passage, on an identical axis.

11. A supercooling degree control type expansion valve according to claim 8, wherein said differential pressure regulating valve bypass means comprises a slit formed in a seating surface of the valve element.

12. A supercooling degree control type expansion valve according to claim 8, wherein said differential pressure regulating valve bypass means comprises a slit formed in a valve seat surface on which the valve element is seated.

13. A supercooling degree control type expansion valve according to claim 8, wherein said differential pressure regulating valve bypass means includes a check valve for closing when pressure on a downstream side of the differential pressure regulating valve becomes higher than pressure on an upstream side of the differential pressure regulating valve.

14. A supercooling degree control type expansion valve according to claim 8, wherein the restriction passage includes passage area-varying means for increasing a passage area thereof in response to received pressure which is higher than a predetermined pressure.

* * * * *